US008523288B2

(12) United States Patent
Hanaoka et al.

(10) Patent No.: US 8,523,288 B2
(45) Date of Patent: Sep. 3, 2013

(54) BIT REPLACING DEVICE FOR EXCAVATING MACHINE

(75) Inventors: Yasuharu Hanaoka, Osaka (JP); Kenji Sudoh, Osaka (JP); Isao Shimada, Osaka (JP)

(73) Assignee: Hitachi Zosen Corporation, Osaka (JP)

( * ) Notice: Subject to any disclaimer, the term of this patent is extended or adjusted under 35 U.S.C. 154(b) by 81 days.

(21) Appl. No.: 13/376,854

(22) PCT Filed: Jun. 3, 2010

(86) PCT No.: PCT/JP2010/059411

§ 371 (c)(1),
(2), (4) Date: Dec. 8, 2011

(87) PCT Pub. No.: WO2010/150630

PCT Pub. Date: Dec. 29, 2010

(65) Prior Publication Data

US 2012/0086260 A1 Apr. 12, 2012

(30) Foreign Application Priority Data

Jun. 26, 2009 (JP) ..... 2009-151677

(51) Int. Cl.
*E21D 9/087* (2006.01)

(52) U.S. Cl.
USPC ..... 299/56; 299/58; 405/144

(58) Field of Classification Search
USPC ..... 299/55, 56, 58; 405/144, 147
See application file for complete search history.

(56) References Cited

U.S. PATENT DOCUMENTS

| | | | | |
|---|---|---|---|---|
| 4,193,637 | A * | 3/1980 | Spencer | 299/56 |
| 6,347,838 | B1 * | 2/2002 | Mukaidani et al. | 299/55 |
| 6,382,732 | B1 | 5/2002 | Tanaka et al. | 299/55 |

FOREIGN PATENT DOCUMENTS

| | | |
|---|---|---|
| JP | 2001-173370 | 6/2001 |
| JP | 2003-253988 | 9/2003 |
| JP | 2003-253989 | 9/2003 |
| JP | 3692267 | 6/2005 |
| JP | 2008-063801 | 3/2008 |

OTHER PUBLICATIONS

Int'l Search Report from corresponding Int'l Patent Application No. PCT/JP2010/059411, 2 Pages.

* cited by examiner

*Primary Examiner* — John Kreck
*Assistant Examiner* — Michael Goodwin
(74) *Attorney, Agent, or Firm* — Kusner & Jaffe

(57) ABSTRACT

An opening for a replacement bit can be closed without a large drive force, the replacement bit can be replaced without being moved, and the workability of replacement is not impaired. A rear surface frame (29) forms a workspace (28) on the rear surface side of a spoke front surface plate (21), and openings (33) are formed on the spoke front surface plate (21) such that a replacement bit (31) can be inserted into and removed from the opening (33). A bit guide body (37) having a bit guide hole (38) is provided on the rear surface side of the opening (33). A gate plate (34) is provided which has valve ports (35) capable of communicating and closing the openings (33) and the bit guide holes (38). A gate opening/closing device (36) is provided which can turn the gate plate (34) to open or close the openings (33).

5 Claims, 9 Drawing Sheets

BIT REPLACING DEVICE FOR EXCAVATING MACHINE

TECHNICAL FIELD

The present invention relates to a bit replacing device provided on the cutter head of an excavating machine, by which a worn bit during excavation can be replaced with a new bit.

BACKGROUND ART

In Patent Literature 1, a rotary support member is arranged in the rear part of the front surface plate of a cutter head so as to rotate about an axial center vertical to the front surface plate. Further, a mounting hole is formed in a position of the rotary support member facing an opening formed on the front surface plate. A replacement bit is slidably contained in the mounting hole. During the replacement of bits, after the replacement bit is retracted from the opening of the front surface plate and is contained in the mounting hole of the rotary support member, the rotary support member is turned 90 degrees, so that the opening is closed by the closing surface portion of the front surface of the rotary support member.

CITATION LIST

Patent Literature

Patent Literature 1: Japanese Patent No. 3692267

However, according to Patent Literature 1, in a state in which the replacement bit is retracted and held in the mounting hole, the rotary support member is turned. Thus, a large rotary drive force is required, so that a large rotation device is disadvantageously required for the rotary support member.

SUMMARY OF INVENTION

Technical Problem

The present invention has been devised to solve the problem. An object of the present invention is to provide a bit replacing device for an excavating machine, by which the need for a large drive force for closing an opening can be eliminated, a replacement bit can be replaced by being retracted only in a linear direction, and the workability is not impaired.

Solution to Problem

In order to solve the above-described problem, the invention according to a first aspect is a bit replacing device for an excavating machine, the bit replacing device being provided on a cutter head which is placed in the front part of an excavating machine body to excavate the ground, and the bit replacing device includes: a rear surface frame provided on the rear surface side of the front surface plate of the cutter head to form a workspace for an operator to enter and exit; an opening into and from which at least one replacement bit can be inserted and removed, the opening being formed on the front surface plate; a bit guide body provided on the rear surface side of the opening, the bit guide body having a bit guide hole through which the replacement bit can be inserted and fixed; a gate plate placed between the front surface plate and the bit guide body so as to turn about an opening/closing axial center vertical to the front surface plate, the gate plate having a valve port through which the replacement bit can be inserted and removed; and a gate opening/closing device capable of turning the gate plate between a communication position for communicating the opening with the bit guide hole and a close position where the opening is closed.

The invention according to a second aspect is the bit replacing device for an excavating machine having the configuration of the first aspect, wherein the at least one replacement bit comprises a plurality of replacement bits provided at equal angles on the same circle centered about the opening/closing axial center of the gate plate.

The invention according to a third aspect is the bit replacing device for an excavating machine having the configuration of the second aspect, wherein the two replacement bits are provided on a radial axis line passing through the rotation axis of the cutter head, and the cross section of the workspace vertical to the radial axis line has a smaller width in the circumferential direction on the rear surface side than that in the circumferential direction on the front surface side.

The invention according to a fourth aspect is the bit replacing device for an excavating machine having the configuration of any one of the first to third aspects, wherein gate sealing materials are provided between the gate plate and the front surface plate and between the gate plate and the bit guide body, respectively, for cut off at the outer periphery of the gate plate and the peripheral edge of the valve port, and a bit sealing material for cut off is provided in a gap between the replacement bit and the bit guide hole.

The invention according to a fifth aspect is the bit replacing device for an excavating machine having the configuration of any one of the first to fourth aspects, wherein the gate opening/closing device includes a gear rotating mechanism having an external gear formed on the outer periphery of the gate plate in the circumferential direction centered about the opening/closing axial center and a pinion engaged with the external gear.

Advantageous Effects of Invention

According to the invention of the first aspect, after the replacement bit protruding from the opening is retracted and contained in the bit guide hole, the gate opening/closing device turns the gate plate from the communication position to the close position, and the valve port provided on the gate plate is displaced from the opening, so that the opening can be closed by the gate plate. Thus, the opening can be closed with a smaller drive device than in the prior art in which the rotary support member is turned together with the replacement bit. With this configuration, the bit guide body has only to be placed via the gate plate on the rear surface of the front surface plate, so that the weight and size of the bit replacing device can be reduced and the workspace can be widely obtained. Further, during the replacement of bits, since soil pressure or water pressure acts, a jig is required for pulling out the replacement bit. However, since the replacement bit is simply retracted in the linear direction and is pulled out without being positioned in other postures by a rotation or side shift, it is possible to easily install a jig. Moreover, the gate plate turned to open or close the opening is placed between the front surface plate and the bit guide body and is not exposed, resulting in high safety. Since the replacement bit is pulled out only backward, it is also possible to easily design the rear surface frame such that the workspace behind the replacement bit can be widely obtained beforehand.

According to the invention of the second aspect, since the multiple replacement bits can be provided on the same circle centered about the opening/closing axial center of the gate plate, the invention is advantageous in manufacturing cost.

Further, since the multiple replacement bits can be closely provided, effective excavation can be achieved.

According to the invention of the third aspect, the cross section of the workspace is formed such that a width in the circumferential direction on the rear surface side (excavating machine body side) is smaller than that in the circumferential direction on the front surface side (cutter head side). Thus, it is possible to reduce frictional resistance due to the intake or agitation of excavated soil. Further, the depth of the workspace is smaller on two sides of the workspace in the circumferential direction. In response, the replacement bit can be arranged on the radial axis line, so that the workspace behind the replacement bit can be widely obtained, and the workability can be enhanced.

According to the invention of the fourth aspect, the gate sealing material can effectively prevent high-pressure mud water from entering the gap between the gate plate and the front surface plate and the gap between the gate plate and the bit guide body. Further, the bit sealing material can effectively prevent high-pressure mud water from entering through the gap between the replacement bit and the bit guide hole.

According to the invention of the fifth aspect, the gate opening/closing device includes the gear rotating mechanism having the external gear and the pinion, so that the gate plate can be easily turned by a manually-operated tool or automatic tool.

DESCRIPTION OF EMBODIMENTS

Referring to the accompanying drawings, the following will describe embodiments of a bit replacing device for a shield machine which is an excavating machine according to the present invention.

First Embodiment

A first embodiment will be described with reference to FIGS. 1A, 1B to 10A, and 10B.

Figure 3:
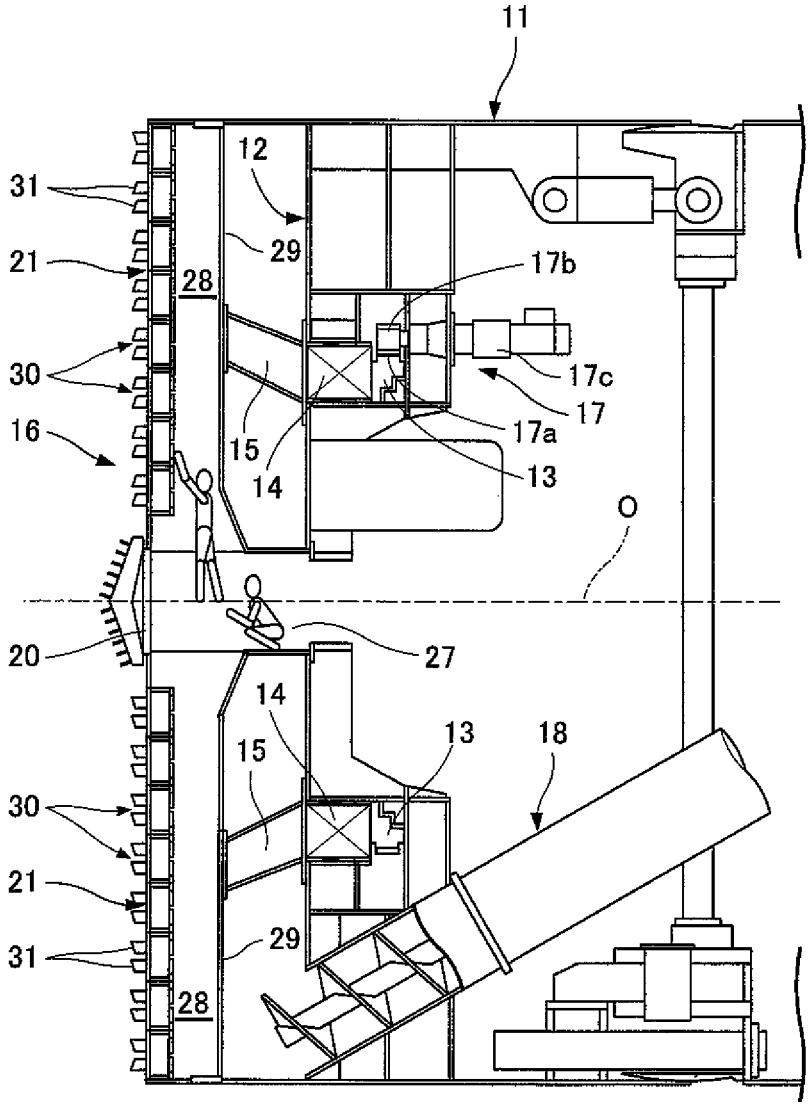
FIG. 3 is a vertical cross-sectional view showing the overall shield machine.

As shown in FIG. 3, a pressure bulkhead 12 keeping a face colluvium pressure is provided in the front part of a cylindrically-shaped shield body (excavating machine body) 11, and a rotary ring body 14 is supported by the pressure bulkhead 12 via a rotary bearing 13 so as to rotate about shield axial center O (excavating machine axial center). A circular cutter head 16 is supported at the front ends of a plurality of support legs 15 projecting forward from the rotary ring body 14. A cutter drive device 17 for rotationally driving the cutter head 16 is provided behind the pressure bulkhead 12. The cutter drive device 17 includes a ring gear 17*a* provided on the backside of the rotary ring body 14, a plurality of drive pinions 17*b* engaged with the ring gear 17*a*, and a plurality of rotation drive devices (hydraulic or electric motors) 17*c* for rotationally driving the drive pinions 17*b*. Further, a screw conveyor for soil removal 18 is provided on the pressure bulkhead 12 to discharge soil excavated by the cutter head 16 backward in the space kept at an atmospheric pressure while keeping a face colluvum pressure.

Figure 2:
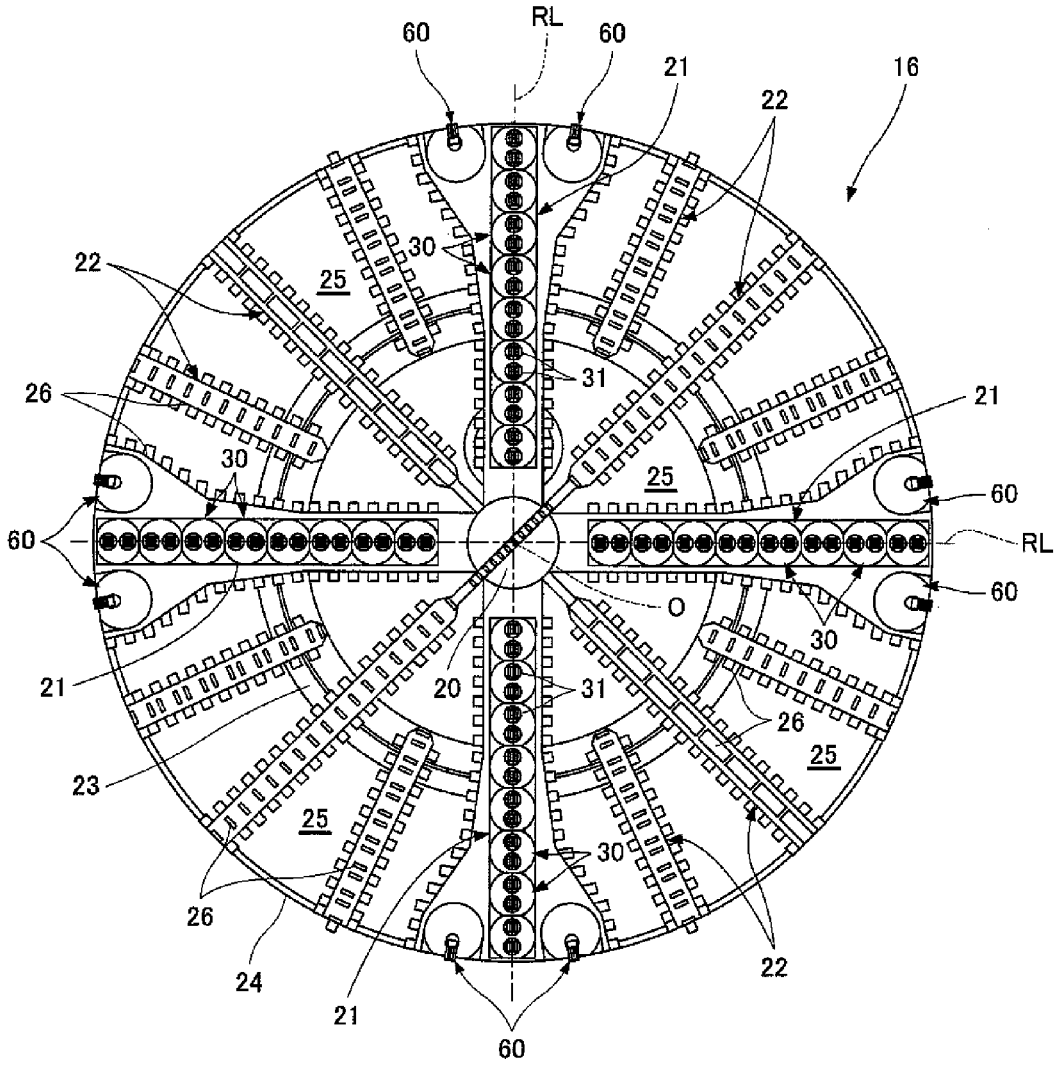
FIG. 2 is a front view showing the overall shield machine.

As shown in FIG. 2, the cutter head 16 includes a plurality of main spoke members 21 extended along a radial axis RL from a center member 20 on the shield axial center O, a plurality of auxiliary spoke members 22 extended between the main spoke members 21 in a radial direction, and an intermediate ring member 23 and an outer peripheral ring member 24 which are placed in an arc direction centered about the shield axial center O to connect the main spoke members 21 and the auxiliary spoke members 22. Soil inlets 25 are formed between the members 21 to 24.

A plurality of bit replacing units (bit replacing devices) 30 of the present invention are arranged on the front part of the main spoke member 21, and two replacement bits 31 are provided for each bit replacing unit 30. Outer peripheral bit replacing units 60 are provided on two sides of the outer peripheral end of the main spoke member 21 in a circumferential direction. Further, a plurality of fixed bits 26 are provided on the respective front and side surfaces of the center member 20 and auxiliary spoke members 22 and the respective side surfaces of the main spoke members 21.

As shown in FIG. 3, on the rear surface side of the center member 20, a manhole 27 is provided through which an operator can enter and exit. The manhole 27 passes through the pressure bulkhead 12 and communicates with the backward space such that the operator can enter and exit from the backward space kept at the atmospheric pressure. Further, a rear surface frame 29 is provided on the rear surface side of the main spoke member 21 to form a workspace 28 which the operator can enter and exit through the manhole 27. In the cross section of the rear surface frame 29 of FIGS. 1A and 1B, a width on the rear surface side in the circumferential direction (direction of rotation) is smaller than that on the front surface side in the circumferential direction (direction of rotation). In other words, the rear surface frame 29 includes right and left side surface plates 29*a* suspended backward from the right and left side edges of a spoke front surface plate (front surface plate) 21*a*, inclined surface plates 29*b* which are inclined inward from the back edges of the right and left side front surface plates 29*a* to the rear surface side, and a rear surface plate 29*c* linking the back edges of the right and left inclined surface plates. The rear surface frame 29 is substantially trapezoidal in cross section such that the width of the rear surface plate 29*c* is small. With this configuration, the frictional resistance due to the intake and agitation of excavated soil is reduced, the strength is ensured, and the workspace 28 has a depth which is tapered backward on two sides of a radial axis line RL (FIGS. 2 and 4) in the circumferential direction.

Figure 4:
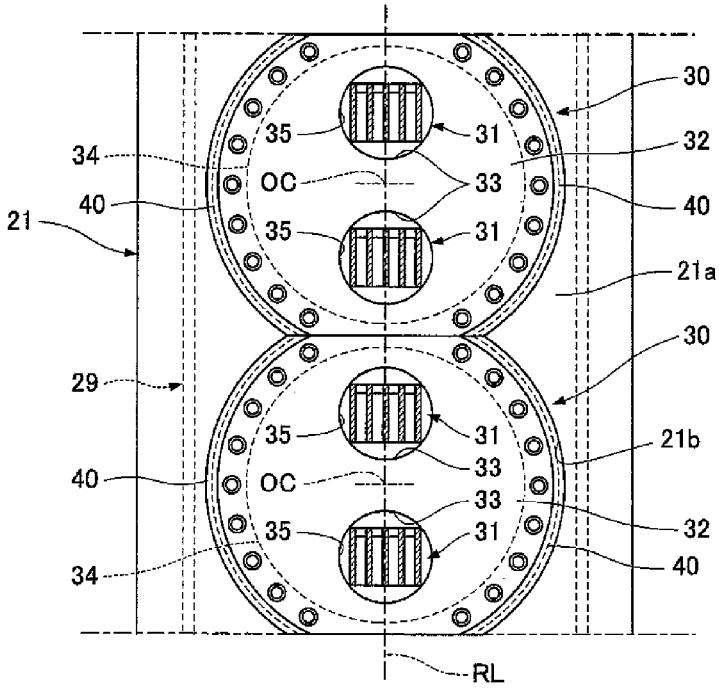
FIG. 4 is a partially enlarged front view showing a main cutter spoke.
Figure 5:
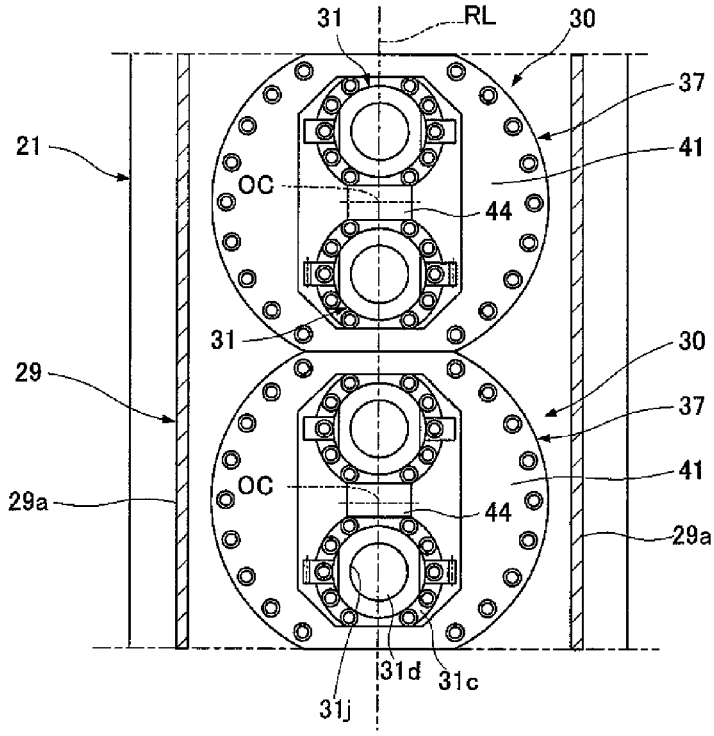
FIG. 5 is a partially enlarged cross-sectional view showing the main cutter spoke as viewed from the rear.

As shown in FIGS. 2, 4, and 5, the bit replacing units 30 are arranged on the main spoke member 21 at a predetermined pitch along the radial direction. Two replacement bits 31 are placed for each bit replacing unit 30 on the radial axis line RL serving as the center of the main spoke member 21, and the widths of the workspace 28 in the depth direction and the circumferential direction behind the replacement bits 31 are sufficiently obtained, so that the workability is improved.

(Replacement Bit)

Figure 1A:
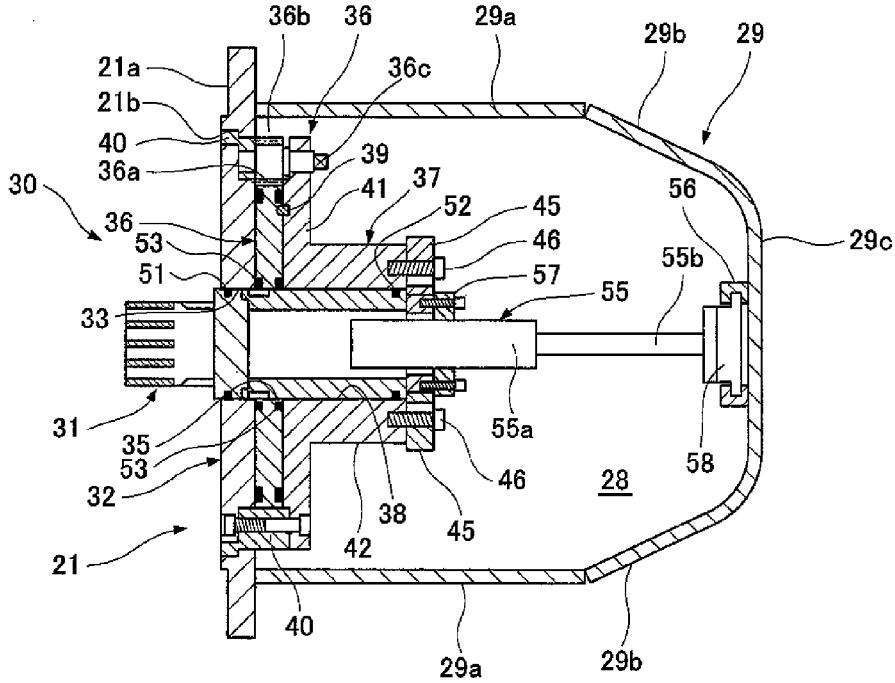
FIG. 1A is a cross-sectional view showing a main spoke member in an excavation use state of a bit in a first embodiment of a bit replacing device of a shield machine according to the present invention.
Figure 1B:
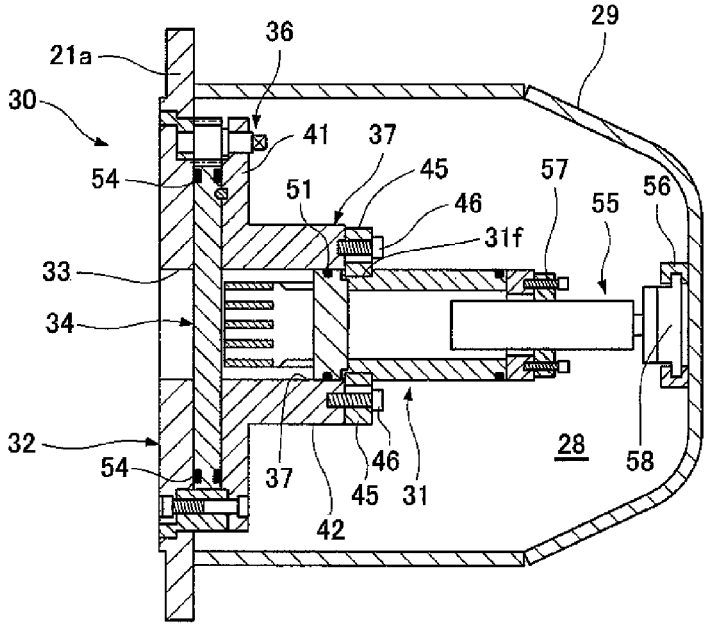
FIG. 1B is a cross-sectional view showing the main spoke member in a replacement retreat state of the bit.
Figure 6:
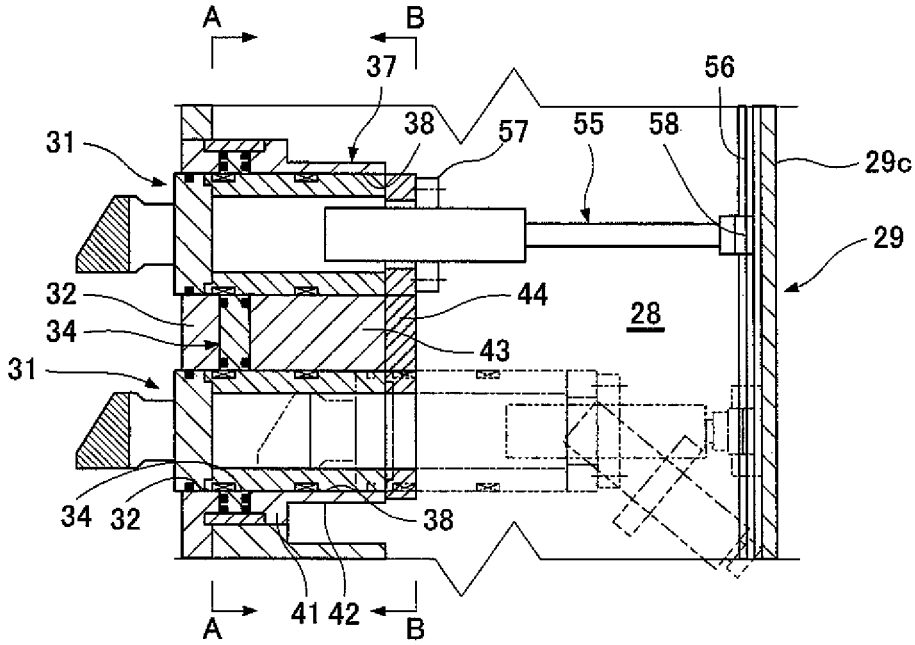
FIG. 6 is a vertical cross-sectional view showing a bit replacing unit.
Figure 7A:
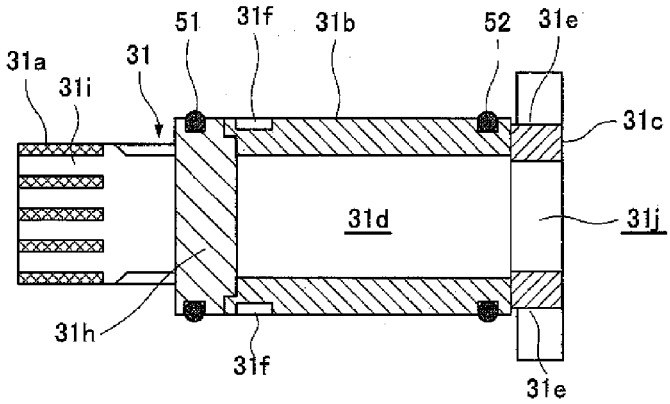
FIG. 7A is a partial cross-sectional view showing a replacement bit as viewed from the bottom.
Figure 7B:
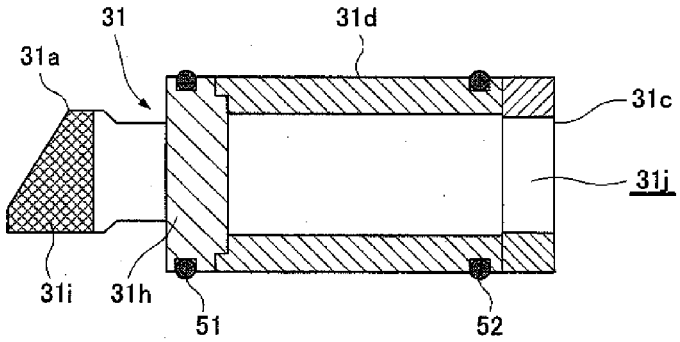
FIG. 7B is a partial cross-sectional view showing the replacement bit as viewed from the side.
Figure 7C:
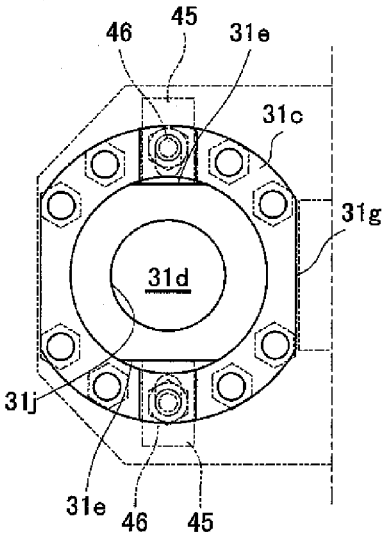
FIG. 7C is a rear view showing the replacement bit.
Figure 8:
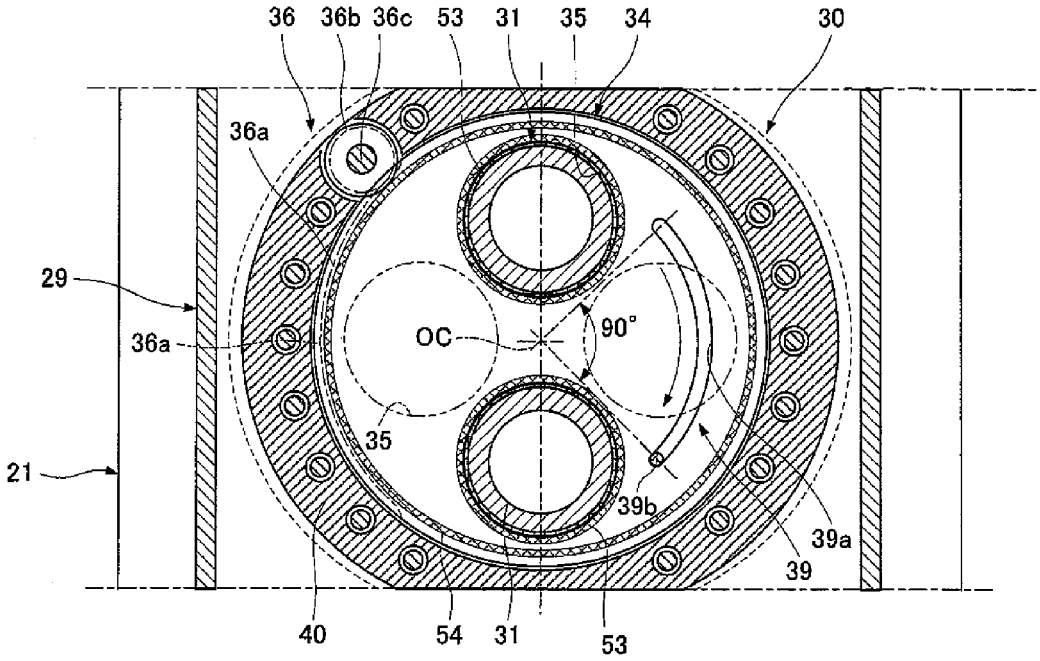
FIG. 8 is a cross-sectional view taken along the line A-A of FIG. 6.
Figure 9:
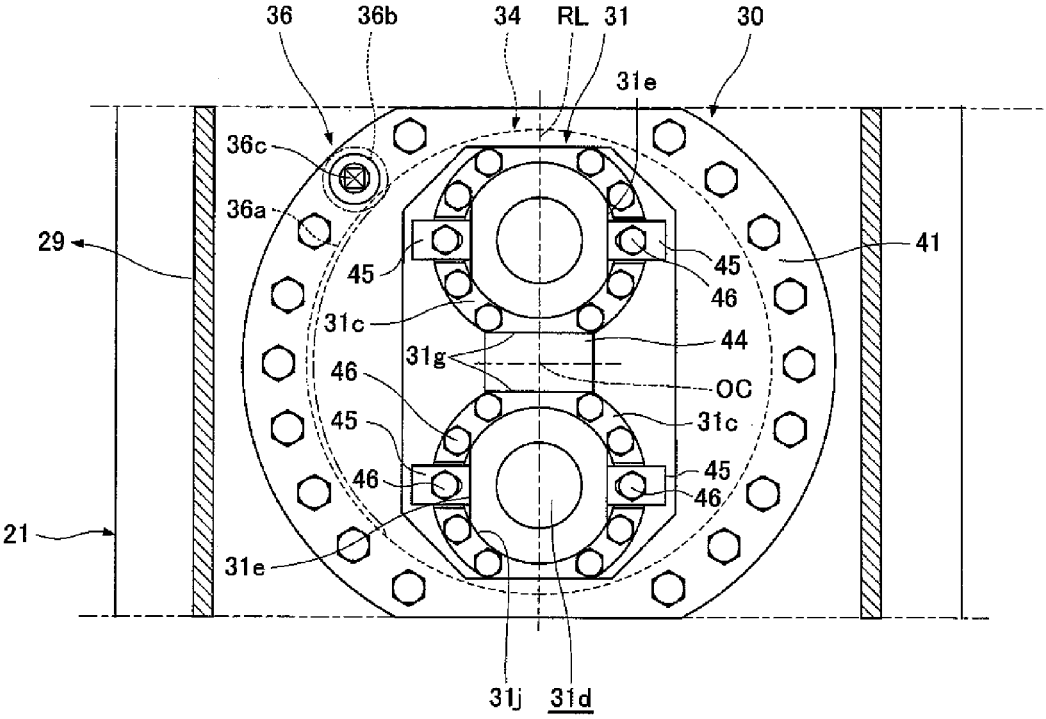
FIG. 9 is a cross-sectional view taken along the line B-B of FIG. 6.

The replacement bit 31 has, as shown in FIGS. 7A to 7C, a cylindrical base cylinder 31*b*, an excavating blade portion 31*a* composed of a base 31*h* attached to the front surface of the base cylinder 31*b* and an excavating blade 31*i* protruded forward from the base 31*h*, and a flange 31*c* which projects from the back end of the base cylinder 31*b* toward the outer peripheral side and has fixing bolt holes. The excavating blade portion 31*a* is smaller in outer diameter than the base cylinder 31*b* and is retractable through a bit guide hole 38 which will be described later. As shown in FIGS. 1A, 1B, and 6, the base cylinder 31*b* has a hollow portion 31*d* into which a push pull jack (jig) 55 is inserted, the push pull jack being capable of pushing and pulling the replacement bit 31. The hollow portion 31*d* communicates with and opens to the workspace 28 via a center hole 31*j* of the flange 31*c*. Use position recesses 31*e* for positioning in an excavation use state are formed in the symmetric positions of the flange 31*c*. Further, retreat position recesses 31*f* for positioning in a replacement retreat position where the replacement bit 31 is retracted are formed in the front part of the base cylinder 31*b*. Moreover, a detent edge 31*g* is provided on the flange 31*c* to notch a face of the flange orthogonally crossing the use position recess 31*e* in a parallel fashion.

(Bit Replacing Unit)

As shown in FIG. 4, the bit replacing unit 30 has continuous mounting holes 21*b* formed on the radial axis line RL on the spoke front surface plate 21*a* of the main spoke member 21, the mounting holes 21*b* having circles parts of which overlap each other. Unit front surface plates 32 are fitted to the circular portions of the mounting holes 21*b* via pairs of right and left mounting ring pieces 40 and are fixed by fixing bolts. Opening/closing axial centers OC are provided in parallel to the shield axial center O at the center positions of the unit front surface plates 32. Openings 33 are formed for each unit front surface plate 32 at two intersection points of arcs centered about the opening/closing axial center OC and the radial axis line RL. Further, as shown in FIGS. 1A, 1B, and 6, a gate plate 34 is arranged on the rear surface side of the unit front surface plate 32 via the mounting ring pieces 40 so as to rotate about the opening/closing axial center OC. The gate plate 34 has two valve ports 35 capable of communicating with and closing the two openings 33. A gate opening/closing device 36 is provided which can reciprocatingly turn the gate plate 34 90 degrees between a communication position where the opening 33 coincides with the valve port 35 and a close position where the valve port 35 is displaced from the opening 33 to close the opening. A bit guide body 37 is attached on the rear surface side of the gate plate 34 and has two guide holes 38 communicating with the openings 33 via the valve ports 35.

(Gate Opening/Closing Device)

The gate opening/closing device 36 includes a gear rotating mechanism having an external gear 36*a*, a pinion 36*b*, and a drive shaft 36*c*. The external gear 36*a* is formed in the range of about 90 degrees in a circumferential direction centered about the opening/closing axial center OC on the outer periphery of the circular gate plate 34. The pinion 36*b* is rotationally supported between the bit guide body 37 and the mounting ring piece 40 to engage with the external gear 36*a*. The drive shaft 36*c* having the pinion 36*b* fixed thereto protrudes to the side of the workspace 28. A manually-operated tool such as a ratchet wrench or an automatic tool such as an electric or hydraulic torque wrench is mounted on the drive shaft 36*c* to rotate the drive shaft 36*c*, drive the gate opening/closing device 36, turn the gate plate 34, and open and close the opening 33.

Further, a rotation regulating tool 39 for regulating a turn of the gate plate 34 is provided on the rear surface (or front surface) of the gate plate 34. The rotation regulating tool 39 includes an arc groove 39*a* and a guide pin 39*b*. The arc groove 39*a* is formed over the range of 90 degrees centered about the opening/closing axial center OC on the rear surface of the gate plate 34. The guide pin 39*b* projects to the inner surface of a face plate portion 41 of the bit guide body 37 and is movably fitted to the arc groove 39*a*. Thus, the turning limit of the gate plate 34 can be formed.

The gate opening/closing device 36 drives the outer periphery of the gate plate 34 to turn, reducing spatial interference with the workspace 28. Further, small torque can turn the gate plate 34, so that opening/closing can be easily performed by simple work equipment such as a manually-operated tool or automatic tool. Moreover, since the gate plate 34 is circularly-formed and the outer periphery is rotationally supported via the mounting ring piece 40, an axis member serving as the turning center of the gate plate 34 becomes unnecessary. Accordingly, the outer diameter of the gate plate 34 can be reduced, resulting in a size reduction in the bit replacing unit 30.

(Bit Guide Body)

The bit guide body 37 includes the face plate portion 41, two holding cylinder portions 42, and a linking block 43. The outer periphery of the face plate portion 41 is fixed to the unit front surface plate 32 via the mounting ring piece 40 by fixing bolts to cover the rear surface of the gate plate 34. The holding cylinder portions 42 project backward from the face plate portion 41 and have the bit guide holes 38. The linking block 43 links the holding cylinder portions 42. A fix block 44 engaged with the detent edge 31*g* of the replacement bit 31 is attached to the rear end surface of the linking block 43. Further, a bolt hole, through which the flange 31*c* of the replacement bit 31 is fixed via fixing bolts, is formed on the rear end surface of the holding cylinder portion 42. Moreover, locking claws 45 for positioning, which can be engaged with and disengaged from the use position recesses 31*e* and retreat position recesses 31*f*, are placed in the symmetric positions via engaging/disengaging bolts 46. The locking claws 45 can be engaged with or disengaged from the use position recess 31*e* and retreat position recess 31*f* and be fixed, since the engaging/disengaging bolts 46 are inserted through the long holes of the locking claws 45.

(Cut-Off Sealing Material)

In the bit replacing unit 30, in order to prevent high-pressure mud water from entering from the face side, first and second bit sealing materials 51 and 52 are mounted on the outer peripheries of the base 31*h* and the rear ends of the base cylinder 31*b* of the replacement bit 31 via mounting grooves. In the use position, the first bit sealing material 51 seals a gap between the replacement bit 31 and the opening 33, and the second bit sealing material 52 seals a gap between the base cylinder 31*b* and the bit guide hole 38. In the replacement retreat position, the first bit sealing material 51 seals a gap between the base 31*h* of the replacement bit 31 and the bit guide hole 38. The first and second bit sealing materials 51 and 52 can be replaced during the replacement of the replacement bit 31, and sufficient sealing properties can be obtained with high reliability.

As a matter of course, the first and second bit sealing materials 51 and 52 can be mounted on the slidable contact surface of the unit front surface plate 32 and the face plate portion 41 via the mounting grooves.

First gate sealing materials 53 are mounted on the peripheral edge of the valve port 35 via mounting grooves on the front and rear surfaces of the gate plate 34. Further, second gate sealing materials 54 are mounted on the outer periphery of the gate plate 34 via mounting grooves. The first and second gate sealing materials 53 and 54 on the front surface prevent mud water from entering a gap between the gate plate 34 and the unit front surface plate 32, and the first and second gate sealing materials 53 and 54 on the rear surface prevent mud water from entering a gap between the gate plate 34 and the face plate portion 41.

The first gate sealing material 53 for sealing the periphery of the valve port 35 passes through the opening 33 and the bit guide hole 38 during a turn of the gate plate 34. However, the first gate sealing material 53 completely adheres to a sliding surface with a low risk of damage during excavation and replacement, so that sufficient sealing properties can be ensured. Further, the second gate sealing material 54 for sealing the outer periphery of the gate plate 34 closely adheres to the sliding surface at all times without a change in the capacity of sealing space and with a low risk of damage, so that sufficient sealing properties can be ensured.

As a matter of course, the first and second gate sealing materials 53 and 54 can be mounted on the side of the unit front surface plate 32 or the face plate portion 41 via mounting grooves.

(Push Pull Jack)

The push pull jack 55 of FIGS. 1A, 1B, and 6 is a jig for pulling and pushing the replacement bit 31, and a fix guide member 56 having a dovetail groove-shaped cross-section is attached to the inner surface of the rear surface plate 29*c* of the rear surface frame 29 along the radial axis RO. Meanwhile, a jack body 55*a* of the push pull jack 55 is inserted into the hollow portion 31*d* of the replacement bit 31, and a connecting ring 57 fixed to the outer periphery of the jack body 55*a* is connected to the flange portion 31*c* via connecting bolts. A piston rod 55*b* of the push pull jack 55 is connected to an engagement block 58 which is adjustably fitted to the fix guide member 56.

Thus, the jack body 55*a* is inserted into the hollow portion 31*d*, and the connecting ring 57 is attached to the replacement bit 31. The piston rod 55*b* is connected to the engagement block 58 fitted to the fix guide member 56. Further, the push pull jack 55 is shrunk, and the replacement bit 31 is pulled out from the opening 33, the valve port 35, and the bit guide hole 38.

With the above-described configuration, bit replacement can be performed similarly to the following bit replacing unit 30.

(Bit Replacement of the Bit Replacing Unit 30)

In a tunnel excavation state, the replacement bit 31 is fixed in an excavation use position. When the excavation proceeds and the replacement bits 31 are worn, the cutter drive device 17 stops at a position where the main spoke member 21 having the targeted replacement bits 31 is positioned, for example, in a horizontal posture. Further, the operator enters the workspace 28 through the manhole 27 to replace the bits.

1) In the workspace 28 of the targeted bit replacing unit 30, the operator inserts the jack bodies 55*a* of the push pull jacks 55 into the hollow portions 31*d* via the center holes 31*j* of the replacement bits 31 from the rear surfaces of the holding cylinder portions 42, so that the jack bodies 55*a* are attached to the flange portions 31*c* of the replacement bits 31 via the connecting rings 57. Further, the engagement blocks 58 are engaged with the fix guide member 56 attached to the rear surface plate 29*c* of the rear surface frame 29, and the piston rods 55*b* of the push pull jacks 55 are extended, so that the push pull jacks 55 are connected to the engagement blocks 58.

2) The fixing bolts of the flange 31*c* are removed, so that the replacement bit 31 and the bit guide bodies 37 are separated from each other. Further, the engaging/disengaging bolts 46 are loosened, so that the locking claws 45 are retracted from the use position recesses 31*e*.

3) When the push pull jacks 55 are shrunk, the replacement bits 31 are retracted, and the leading ends of the excavation blade portions 31*a* pass through the valve ports 35 of the gate plates 34 and are contained in the bit guide holes 38, the locking claws 45 protrude to be engaged with the retreat position recesses 31*f*, the engaging/disengaging bolts 46 are tightened, and the replacement bits 31 are fixed in the replacement retreat positions.

4) When the two replacement bits 31 are fixed in the replacement retreat positions, a manually-operated tool or automatic tool is used to rotationally drive the drive shaft 36*c* of the gate opening/closing device 36. When the gate plate 34 is turned 90 degrees by means of an opening/closing gear mechanism, the gate plate 34 closes the two openings 33.

5) The piston rods 55*b* of the push pull jacks 55 and the fix guide member 56 are separated from each other, the connecting rings 57 of the jack bodies 55*a* are removed out from the flanges 31*c* of the replacement bits 31, the push pull jacks 55 are separated from the replacement bits 31, and then the push pull jacks 55 are removed out.

6) After the engaging/disengaging bolts 46 are loosened and the locking claws 45 are retracted from the retreat position recesses 31*f*, the worn replacement bits 31 are removed out from the bit guide holes 38 and are transported.

7) New replacement bits 31 transported into the workspace 28 are loaded into the bit guide holes 38. The locking claws 45 are engaged with the retreat position recesses 31*f*, the engaging/disengaging bolts 46 are tightened, and the replacement bits 31 are fixed in the replacement retreat positions.

8) The jack bodies 55*a* of the push pull jacks 55 are inserted into the hollow portions 31*d* through the center holes 31*j* of the replacement bits 31, and the jack bodies 55*a* are fixed to the flanges 31*c* of the replacement bits 31 via the connecting rings 57. Further, the engagement block 58 engaged with the fix guide member 56 and the piston rod 55*b* of the push pull jack 55 are connected to each other.

9) The gate opening/closing device 36 is driven by the manually-operated tool or automatic tool to turn the gate plate 34 90 degrees in the opposite direction, the valve ports 35 coincide with the two openings 33, and the openings 33 are opened.

10) After the engaging/disengaging bolts 46 are loosened and the locking claws 45 are retracted from the retreat position recesses 31*f*, the push pull jacks 55 are extended to push the replacement bits 31 into the bit guide holes 38. The excavation blade portions 31*a* protrude forward from the valve ports 35 via the openings 33. Further, the locking claws 45 are engaged with the use position recesses 31*e* to be positioned, and the flanges 31*c* and the holding cylinder portions 42 are connected to each other by the fixing bolts, and new replacement bits 31 are fixed to the bit guide bodies 37 in the excavation use position.

11) The connecting rings 57 provided on the jack bodies 55*a* of the push pull jacks 55 are detached from the flanges 31*c* of the replacement bits 31, and the piston rods 55*b* and the fix guide member 56 are separated from each other, and the push pull jacks 55 are removed out from the replacement bits 31.

(Outer Peripheral Bit Replacing Unit)

Figure 10A:
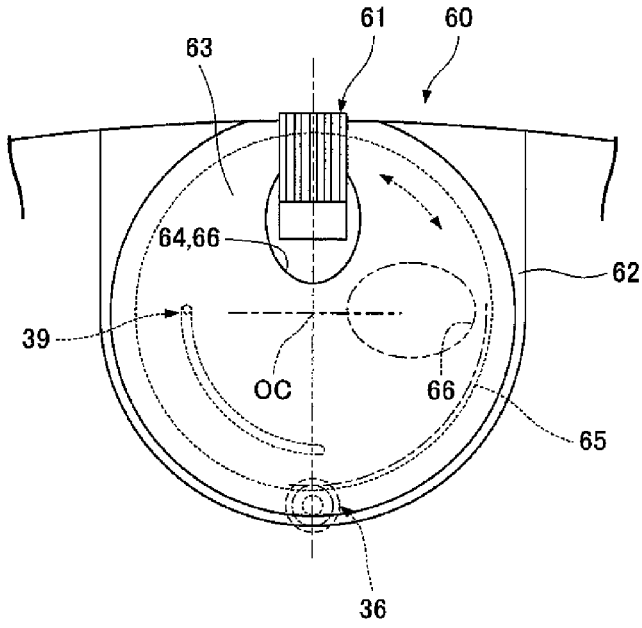
FIG. 10A is a front view showing an outer peripheral bit replacing unit.
Figure 10B:
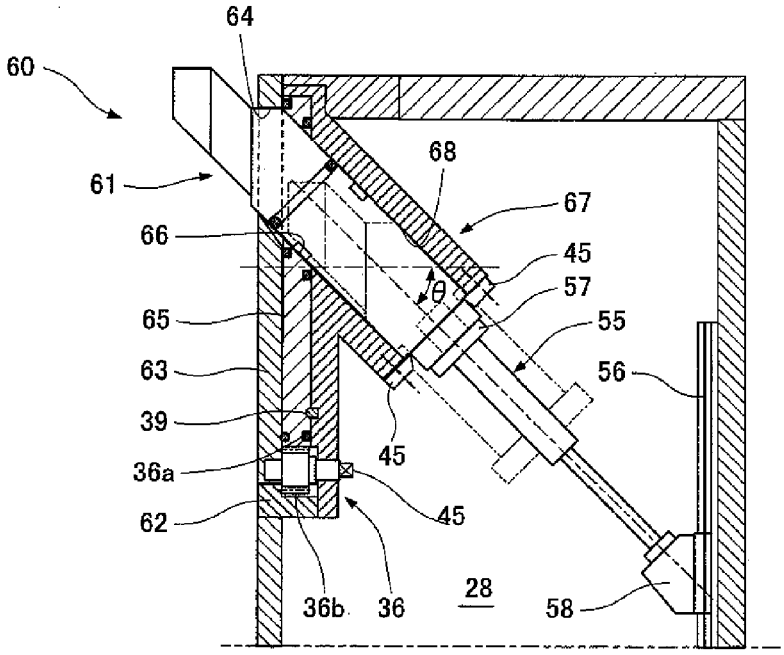
FIG. 10B is a vertical center cross-sectional view showing the outer peripheral bit replacing unit.

As shown in FIGS. 10A and 10B, an outer periphery excavation bit (replacement bit) 61 for outer periphery excavation is provided in the outer peripheral bit replacing unit 60. The outer periphery excavation bit 61 is tilted forward at θ° to the opening/closing axial center, OC in an outer peripheral direction. A circular outer peripheral unit front surface plate 63 is attached to an outer peripheral front plate connected to the main spoke member 21 of the cutter head 16 via a mounting ring 62, and an opening 64 is formed close to the outer periphery of the outer peripheral unit front surface plate 63. A gate plate 65 is placed on the rear surface of the outer peripheral unit front surface plate 63 via the mounting ring 62 so as to turn about the opening/closing axial center OC in the range of 90 degrees. A valve port 66 is formed on the gate plate 65 so as to coincide and communicate with the opening 64. A bit guide body 67 is also attached to the rear surface of the outer peripheral unit front surface plate 63 via the mounting ring 62. The bit guide body 67 has a bit guide hole 68 communicating with the valve port 66 and the opening 64, and is tilted at the same angle θ°. Other constituent elements are configured similarly to those in the gate opening/closing device 36 and the bit replacement unit 30 and are indicated by the same reference numerals, and an explanation thereof is omitted.

Effects of the First Embodiment

In the first embodiment, after the replacement bit 31 is retracted and contained in the bit guide hole 38 of the bit guide body 37, the gate plate 34 is turned by the gate opening/closing device 36, the valve port 35 is displaced from the opening 33, and the opening 33 is closed by the gate plate 34.

Thus, compared to the prior art in which a replacement bit is rotated concurrently with a rotary support member, the opening 33 can be closed with a small drive force since the gate plate 34 having the valve port 35 is turned. Further, the bit guide body 37 has only to be placed on the rear surface of the spoke front surface plate 21*a* via the gate plate 34, so that the weight and size of the bit replacement unit 30 can be reduced and the workspace 28 can be widely obtained.

Further, since soil pressure or water pressure acts during the replacement of bits, the push pull jack 55 is required to pull or push the replacement bit 31. However, the replacement bit 31 is simply retracted in a linear direction but is not positioned in other postures by a turn or side shift, so that the push pull jack 55 can be easily placed.

The gate plate 34 is mounted between the spoke front surface plate 21*a* and the face plate portion 41 of the bit guide body 37, the outer periphery of the gate plate 34 is surrounded by the mounting ring piece 40, and the driven portion is not exposed into the workspace 28. Thus high safety is provided.

Moreover, the cross section of the workspace 28 formed by the rear surface frame 29 is formed such that the width in the circumferential direction on the rear surface side (excavating machine body side) is narrower than that on the front surface side (cutter head side). Thus frictional resistance due to the intake or agitation of excavated soil can be reduced while ensuring strength. Furthermore, since the replacement bit 31 is placed on the radial axis line RL and is retracted only backward along the linear direction during replacement, the workspace 28 can be sufficiently ensured in a direction of pulling out the replacement bit 31 during replacement, resulting in an improvement in workability.

Since the first and second gate sealing materials 53 and 54 are provided, it is possible to effectively prevent high-pressure mud water from entering through the gap between the gate plate 34 and the unit front surface plate 32 and a gap between the gate plate 34 and the bit guide body 37. Further, since the first and second bit sealing materials 51 and 52 are provided, it is possible to effectively prevent high-pressure mud water from entering the gap between the replacement bit 31 and the bit guide hole 38.

Moreover, since the gate opening/closing device 36 includes the gear rotating mechanism having the external gear 36*a* and the pinion 36*b*, the gate plate 34 can be turned by a manually-operated tool or automatic tool to easily open or close the opening 33.

Second Embodiment

Bit Replacing Unit

Figure 11A:
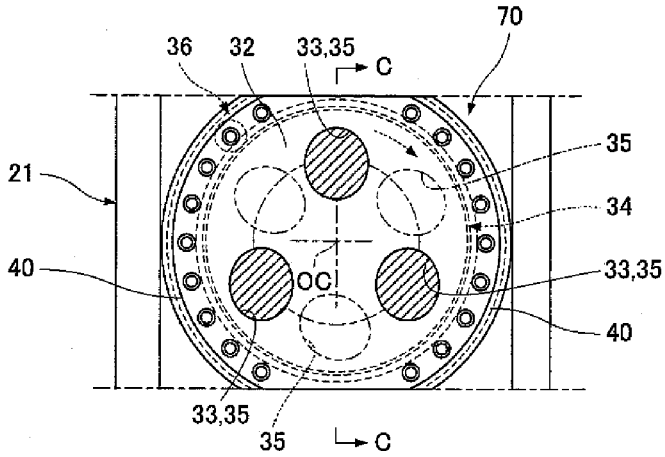
FIG. 11A is a front view of a bit replacing unit showing a second embodiment of the bit replacing device of the shield machine according to the present invention.
Figure 11B:
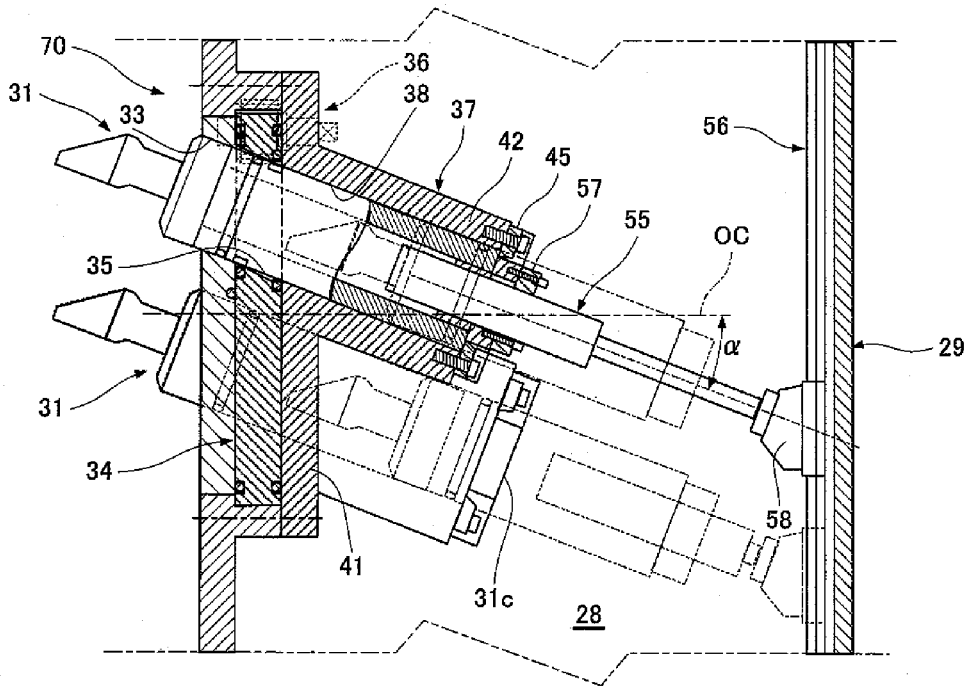
FIG. 11B is a cross-sectional view taken along the line C-C of FIG. 11A.

In the bit replacing unit 30 of the first embodiment, the two replacement bits 31 (openings 33) are placed on the radial axis line RL. However, as shown in FIGS. 11A and 11B, in a bit replacing unit 70, three replacement bits 31 are provided at regular intervals (equal angles) centered about an opening/closing axial center OC. In other words, in the bit replacing unit 70, openings 33, valve ports 35, and bit guide holes 38 are formed 120° apart on the same arc centered about the opening/closing axial center OC, and the three replacement bits 31 are provided. The replacement bits 31 are tilted α° toward the front outer peripheral side, and a gate opening/closing device 36 reciprocatingly turns a gate plate 34 in the range of 120°. Other configurations are the same as those in the first embodiment, the same components are indicated by the same reference numerals, and an explanation thereof is omitted.

In the bit replacing unit 70, the three replacement bits 31 can be provided, advantageously reducing cost, and the three replacement bits 31 can be closely provided, thereby enabling effective excavation. Further, the replacement bits 31 are tilted, so that the workspace 28 can be effectively used.

Having described the invention, the following is claimed:

1. A bit replacing device for an excavating machine, the bit replacing device being provided on a cutter head which is placed in a front part of an excavating machine body to excavate ground, the bit replacing device comprising:

a rear surface frame provided on a rear surface side of a front surface plate of the cutter head to form a workspace for an operator to enter and exit;

an opening into and from which at least one replacement bit can be inserted and removed, the opening being formed on the front surface plate;

a bit guide body provided on a rear surface side of the opening, the bit guide body having a bit guide hole through which the replacement bit can be inserted and fixed;

a gate plate placed between the front surface plate and the bit guide body so as to turn about an opening/closing axial center normal to the front surface plate, the gate plate having a valve port through which the replacement bit can be inserted and removed; and a gate opening/closing device capable of turning the gate plate between a communication position for communicating the opening with the bit guide hole and a closed position where the opening is closed.

2. The bit replacing device for an excavating machine according to claim 1, wherein the at least one replacement bit comprises a plurality of replacement bits provided at equal angles on a circle having a center that aligns with the opening/closing axial center of the gate plate.

3. The bit replacing device for an excavating machine according to claim 2, wherein the two replacement bits are provided on a radial axis line passing through a rotation axis of the cutter head, and a cross section of the workspace normal to the radial axis line has a smaller width in a circumferential direction on a rear surface side than that in the circumferential direction on a front surface side.

4. The bit replacing device for an excavating machine according to any one of claims 1 to 3, wherein gate sealing materials are provided between the gate plate and the front surface plate and between the gate plate and the bit guide body, respectively, for sealing at an outer periphery of the gate plate and a peripheral edge of the valve port, and a bit sealing material for sealing is provided in a gap between the replacement bit and the bit guide hole.

5. The bit replacing device for an excavating machine according to any one of claims 1 to 3, wherein the gate opening/closing device comprises a gear rotating mechanism having an external gear formed on the outer periphery of the gate plate in a circumferential direction centered about the opening/closing axial center and a pinion engaged with the external gear.

* * * * *